US008308503B2

(12) United States Patent
Yaguchi et al.

(10) Patent No.: US 8,308,503 B2
(45) **Date of Patent: *Nov. 13, 2012**

(54) FLAT CABLE AND CONNECTION STRUCTURE BETWEEN FLAT CABLE AND PRINTED WIRING BOARD

(75) Inventors: Akihiro Yaguchi, Kasama (JP); Takumi Kobayashi, Hitachi (JP); Kenichi Murakami, Hitachi (JP); Hiroaki Komatsu, Hitachi (JP)

(73) Assignee: Hitachi Cable, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/137,331

(22) Filed: Aug. 5, 2011

(65) Prior Publication Data

US 2012/0184130 A1 Jul. 19, 2012

(30) Foreign Application Priority Data

Jan. 13, 2011 (JP) ..... 2011-005105

(51) Int. Cl.
*H01R 12/24* (2006.01)

(52) U.S. Cl. ..... 439/492

(58) Field of Classification Search ..... 439/492, 439/496, 493, 495, 499

See application file for complete search history.

(56) References Cited

U.S. PATENT DOCUMENTS

| | | | | |
|---|---|---|---|---|
| 7,189,105 | B2 * | 3/2007 | Takaku et al. | 439/497 |
| 7,789,678 | B2 * | 9/2010 | Nagata et al. | 439/108 |
| 7,988,465 | B2 * | 8/2011 | Chuo et al. | 439/98 |
| 2009/0221165 | A1 * | 9/2009 | Buck et al. | 439/108 |
| 2010/0081334 | A1 * | 4/2010 | Kagotani | 439/639 |

FOREIGN PATENT DOCUMENTS

| | | | |
|---|---|---|---|
| JP | 8-203577 | A | 8/1996 |
| JP | 2001-143784 | A | 5/2001 |
| JP | 2002-216873 | A | 8/2002 |

OTHER PUBLICATIONS

U.S. Appl. No. 13/137,330, filed Aug. 5, 2011.*

* cited by examiner

*Primary Examiner* — Tulsidas C Patel
*Assistant Examiner* — Phuongchi Nguyen
(74) *Attorney, Agent, or Firm* — McGinn IP Law Group, PLLC

(57) ABSTRACT

A flat cable includes a plurality of conductors arranged in parallel and exposed at both end portions in a longitudinal direction thereof, an insulation film covering the plurality of conductors except the exposed both end portions, and a reinforcing member that covers the plurality of conductors along a width direction of the plurality of conductors, is provided on a surface of the insulation film in a part of a region including an edge of the insulation film, and includes a metal plate and an insulative covering layer for covering the metal plate.

13 Claims, 9 Drawing Sheets

FLAT CABLE AND CONNECTION STRUCTURE BETWEEN FLAT CABLE AND PRINTED WIRING BOARD

The present application is based on Japanese Patent Application No. 2011-005105 filed on Jan. 13, 2011, the entire contents of which are incorporated herein by reference.

BACKGROUND OF THE INVENTION

1. Field of the Invention

The invention relates to a flat cable, and a connection structure between a flat cable and a printed wiring board.

2. Description of the Related Art

Conventionally, a wire harness is used as a wiring component for electrically connecting plural printed wiring boards which are mounted inside an on-vehicle inverter unit or an engine control unit, etc., and a connection structure using a connector component is employed for connection between the wire harness and the printed wiring board. In recent years, use of an alternative wiring component in place of wire harness, an application of a connection method not using a connector component and simplification of connection process are required as a measure of realizing both downsizing/thinning and cost reduction of on-vehicle devices.

In order to respond to such downsizing and cost reduction of on-vehicle devices, an inter-board connection structure has been proposed in which a flat cable called Flexible Flat Cable (FFC) including plural conductors (conductor formed of, e.g., Cu alloy [oxygen-free copper, tough pitch copper], etc.) longitudinally arranged in parallel which are adhesively coated and integrated by a covering insulation film from both sides of the conductors in a thickness direction using an adhesive material is employed as a wiring component used in an on-vehicle device. In the FFC, an exposed conductor portion which is exposed from the insulation film is formed at both longitudinal ends of the conductor, and is connected to an electrode portion of a printed wiring board. And also, Multi Frame Joiner (MFJ) and Flexible Print Circuit (FPC), etc., are employed for a flat cable used as a wiring component in an on-vehicle device.

For connection between the exposed conductor portion of the flat cable and the electrode portion provided on the printed wiring board, a structure of direct connection using a joining material such as solder material or conductive adhesive material not through a connector may be employed. A direct connection using a solder material, etc., allows not only downsizing in accordance with a decrease in a connecting area and reduction of the number of connecting parts but also reduction or simplification of attachment processes by simultaneously performing the direct connection with solder connection of electronic component attached to the printed wiring board other than the wiring component.

On the other hand, high durable reliability for long time use has been always required for on-vehicle devices. Ensuring of reliability against long-term vibration load or thermal load is also vital for a wiring component attached to an on-vehicle device or a connecting portion thereof. In a wiring component for connecting plural printed wiring boards, mechanical load repeatedly acts on a connecting portion of the wiring component due to resonant vibration of the wiring component itself, etc., caused by vibration load acting on the on-vehicle device. There is a high possibility that a fatigue fracture occurs at the connecting portion of the wiring component due to the mechanical load, hence, it is especially important to ensure reliability against vibration load in a wiring component for on-vehicle devices.

Ensuring of long-term reliability is vital for on-vehicle devices, and a flat cable itself and a connecting portion thereof are also required to ensure reliability against vibration load or thermal load. Particularly, reliability against mechanical load such as vibration or impact is important for on-vehicle devices which are mounted inside an engine compartment. In order to improve reliability, it is necessary to optimize the entire structure of the on-vehicle device and also to study a structure or means which reduces load applied to the connecting portion of the flat cable and improves resistance against mechanical load.

The inter-board wiring component to connect an exposed conductor portion of a flat cable to an electrode portion of a printed wiring board using a solder material has a structure in which load is likely to be applied to the vicinity of the connecting portion of the exposed conductor portion. Large stress is concentrated especially on an exposed conductor portion at a covering material end portion or an upper end portion of a solder connection fillet at the tip of the exposed conductor portion.

When mechanical load, especially high amplitude mechanical load in a thickness direction of the flat cable (a direction to separate a connection interface between the electrode portion of the printed wiring board and the exposed conductor portion of the flat cable) acts on the connecting portion between the electrode portion of the printed wiring board and the exposed conductor portion of the flat cable, fracture or separation of the connecting portion or breaking of the exposed conductor portion of the flat cable may occur.

As a method of reducing load applied to the connecting portion between the exposed conductor portion of the flat cable and the electrode portion of the printed wiring board, a method is suggested in which a flat wiring material restricting clip is provided to restrict a flat wiring material such as FFC or FPC to a circuit board and the flat wiring material is pressed down on the circuit board at a portion closer to the edge of the circuit board than to the conductor end portion of the flat wiring material by the flat wiring material restricting clip in a state that the conductor of the flat wiring material is connected to the circuit board (see, e.g., JP-A-2001-143784).

According to the means of pressing down the flat wiring material on the circuit board by the flat wiring material restricting clip in a state that the conductor of the flat wiring material is connected to the circuit board as described in JP-A-2001-143784, when an external mechanical force in a separating direction is applied to the connecting portion of the flat wiring material, it is possible to prevent the force from acting on the connecting portion by restriction of the flat wiring material restricting clip. As a result, it is possible to prevent damage to the connecting portion between the circuit board and the flat wiring material.

Meanwhile, as a means of reinforcing a connecting portion between a conductor of a flat cable and a circuit of a printed wiring board, a method is suggested in which a right-angle bent portion is formed on a conductor at an end portion of the FFC, and an end portion of the conductor of the FFC is inserted into a hole formed on a corresponding circuit of the printed wiring board (FPC, etc.), the conductor of the FFC is fixed to the back surface of the FPC by pressure bonding or soldering and the connecting portion therebetween is reinforced by plastic reinforcement plates from both sides of the conductor or by enhancing adhesion between the flat cable and the printed wiring board by holding with an adhesive tape (see, e.g., JP-A-8-203577).

According to the means of reinforcing the connecting portion between the conductor of the flat cable and the circuit of the printed wiring board as described in JP-A 8-203577, the reinforcement plates sandwich or the adhesive tape is wound several times around the conductor of the flat cable as well as the circuit of the printed wiring board from both upper and lower sides to fix the conductor of the flat cable to the circuit of the printed wiring board at the connecting portion, and it is thereby possible to reduce external mechanical force which acts on the connecting portion.

In addition, as a means of connecting and fixing a flat cable or a cable of a flexible wiring board, etc., to a printed wiring board, a method in which a fixing plate (a plate formed of metal) for applying pressure to a cable placed on a printed wiring board is provided at an upper portion of the cable and is fixed to the printed wiring board by a screw, and a method in which a cable is fixed to a printed wiring board by inserting a terminal having a claw formed at a tip thereof into a hole provided on the printed wiring board are suggested (see, e.g., JP-A-2002-216873).

According to the means of fixing a flat cable or a cable of a flexible wiring board to a printed wiring board as described in JP-A-2002-216873, the fixing board which covers the connecting portion between a conductor of the cable and the printed wiring board can be fixed to the printed wiring board by a terminal having a claw formed at a tip thereof, and it is thereby possible to reduce external mechanical force which acts on the connecting portion.

SUMMARY OF THE INVENTION

However, the method described in JP-A-2001-143784 has a structure in which the flat wiring material restricting clip is formed by bending a single rod and the flat wiring material is pressed against the circuit board by an elastic deformation force (spring force) of a portion which is bent into a shape of sandwiching the circuit board. There is a concern that the elastic deformation force of the flat wiring material restricting clip gradually deteriorates due to mechanical load such as vibration which is repeatedly applied for long term. It is believed that an external mechanical force in a separating direction which acts on the connecting portion of the flat wiring material is gradually increased due to deterioration in the elastic deformation force, i.e., restricting force, leading to damage at some stage.

Meanwhile, the structure described in JP-A-8-203577 is to reinforce by covering the connecting portion together with the flat cable and the printed wiring board, hence, an area for providing the reinforcing member becomes larger than the width of the flat cable or the width of the printed wiring board, which is a cause of impeding the downsizing of the connecting portion.

In addition, in the technique described in JP-A-8-203577, it is configured to reinforce the connecting portion by a plastic reinforcement plate or an adhesive tape. It is anticipated that the plastic reinforcement plate does not have enough rigidity against mechanical load when being mounted on an on-vehicle device, and a sufficient load suppression effect may not be obtained.

Furthermore, in the means described in JP-A-2002-216873, it is anticipated that looseness occurs at a fixed portion between the screw or the terminal having a claw formed at a tip thereof and the printed wiring board due to the mechanical load such as vibration which is repeatedly applied for long term. The looseness lowers the restricting force of the fixing board and increases the external mechanical force acting on the connecting portion of the cable conductor, which may lead to damage to the conductor of the cable.

In addition, for connecting the exposed conductor portion of the flat cable to the electrode of the printed wiring board, there is a case to use a structure in which an S-shaped bent portion is formed on the exposed conductor portion and the tip portion of the bent portion is placed on and solder-connected to the electrode of the printed wiring board. In this connection structure, a gap is generated between a lower surface of the flat cable (a surface facing the printed wiring board) and an upper surface of the printed wiring board at a root portion of a film of the exposed conductor portion.

When the technique described in JP-A-2001-143784 is used in a state that a gap is present between the flat cable and the printed wiring board in the vicinity of the connecting portion, it is anticipated that the flat cable is deformed toward the printed wiring board due to the elastic deformation force (spring force) of the flat wiring material restricting clip. Such deformation generates mechanical stress in the solder connection portion of the exposed conductor portion or in the conductor at the film edge, and the stress may cause damage to the stress generation portion by continuously acting thereon for long period of time.

In addition, since the technique described in JP-A-8-203577 is also a structure to press the flat cable against the printed wiring board by a reinforcement plate or an adhesive tape, the same problem as JP-A-2001-143784 may occur. Furthermore, since the technique described in JP-A-2002-216873 is also a structure to press the cable conductor connecting portion against the printed wiring board by a fixing plate formed of metal, the same problem as the techniques described in JP-A-2001-143784 and JP-A-8-203577 may occur.

Thus, in the conventional connecting method, there is a concern that the restricting force decreases due to mechanical load such as vibration for long time or impact or the flat cable is deformed.

Accordingly, it is an object of the invention to provide a flat cable and a connection structure between a flat cable and a printed wiring board in which, for connecting an exposed conductor portion of a flat cable to a corresponding electrode portion formed on a printed wiring board by a solder material, it is possible to ensure stable connection reliability against mechanical load such as vibration for long time or impact without causing fracture or damage to a connecting portion.

(1) According to one embodiment of the invention, a flat cable comprises:

a plurality of conductors arranged in parallel and exposed at both end portions in a longitudinal direction thereof;

an insulation film covering the plurality of conductors except the exposed both end portions; and a reinforcing member that covers the plurality of conductors along a width direction of the plurality of conductors, is provided on a surface of the insulation film in a part of a region including an edge of the insulation film, and comprises a metal plate and an insulative covering layer for covering the metal plate.

In the above embodiment (1) of the invention, the following modifications and changes can be made.

(i) The plurality of conductors are arranged in parallel in the width direction to form a conductor group, the both end portions comprise externally exposed portions, the exposed portion comprises a conductor connecting portion provided in a region including a tip of the exposed portion so as to be connectable to an external conductor, and the reinforcing member partially covers the conductor group along a width direction to traverse thereacross and is provided so that a center of the reinforcing member is located a predetermined distance away from the edge of the insulation film.

(ii) The reinforcing member is adapted to be fixed to an external printed wiring board.

(iii) A portion of the metal plate of the reinforcing member comprises an exposed metal plate portion that is exposed from the insulative covering layer, and the exposed metal plate portion is adapted to be fixed to the external printed wiring board.

(iv) The exposed metal plate portion is adapted to be inserted into and fixed to a through-hole in the external printed wiring board.

(v) The reinforcing member is provided on a surface of the insulation film that is not facing a surface of the external printed wiring board, and the flat cable further comprises an intervening portion provided on a surface of the insulation film facing a surface of the external printed wiring board at substantially the same position as the region provided with the reinforcing member so as to be positioned between the surface of the external printed wiring board and the insulation film.

(vi) The intervening portion comprises a base material and an adhesive formed on both surfaces of the base material such that the adhesive allows the intervening portion to be bonded to the surface of the external printed wiring board and the insulation film.

(2) According to another embodiment of the invention, a connection structure between a flat cable and a printed wiring board comprises:

a printed wiring board; and a flat cable, wherein the flat cable comprises:

a plurality of conductors arranged in parallel and exposed at both end portions in a longitudinal direction thereof;

an insulation film covering the plurality of conductors except the exposed both end portions; and a reinforcing member that covers the plurality of conductors along a width direction of the plurality of conductors, is provided on a surface of the insulation film in a part of a region including an edge of the insulation film, and comprises a metal plate and an insulative covering layer for covering the metal plate, and wherein a portion of the reinforcing member is fixed to the printed wiring board.

In the above embodiment (2) of the invention, the following modifications and changes can be made.

(vii) The plurality of conductors are arranged in parallel in the width direction to form a conductor group, the both end portions are externally exposed portions, the exposed portion comprises a conductor connecting portion provided in a region including a tip of the exposed portion so as to be connectable to an external conductor, the reinforcing member partially covers the conductor group along a width direction to traverse thereacross and is provided so that a center of the reinforcing member is located a predetermined distance away from the edge of the insulation film, and fixed to the printed wiring board, and the printed wiring board further comprises a plurality of electrode portions respectively connected to a plurality of the conductor connecting portions so as to respectively correspond to the plurality of conductors.

(viii) A portion of the metal plate of the reinforcing member comprises an exposed metal plate portion that is exposed from the insulative covering layer, and the exposed metal plate portion is fixed to the printed wiring board.

(ix) The exposed metal plate portion is inserted into and fixed to a through-hole of the printed wiring board.

(x) The reinforcing member is provided on a surface of the insulation film that is not facing a surface of the printed wiring board, and further comprised is an intervening portion provided on a surface of the insulation film facing a surface of the printed wiring board at substantially the same position as the region provided with the reinforcing member so as to be positioned between the surface of the printed wiring board and the insulation film.

(xi) The intervening portion comprises a base material and an adhesive formed on both surfaces of the base material such that the adhesive allows the intervening portion to be bonded to the surface of the external printed wiring board and the insulation film.

POINTS OF THE INVENTION

According to one embodiment of the invention, a flat cable is constructed such that a reinforcing member covering plural conductors along the width direction at both end portions of the plural conductors is composed of a strip-shaped metal plate and a covering member as an insulative covering layer for covering the metal plate. Thus, it is possible to improve rigidity of the reinforcing member by forming a center region thereof using the metal plate. In addition, it is also possible to improve rigidity in the vicinity of the solder connection portion of the conductors to which the reinforcing member is fixed.

BRIEF DESCRIPTION OF THE DRAWINGS

The present invention will be explained below in more detail in conjunction with appended drawings, wherein.

DETAILED DESCRIPTION OF THE PREFERRED EMBODIMENTS

Embodiment

Figure 1:
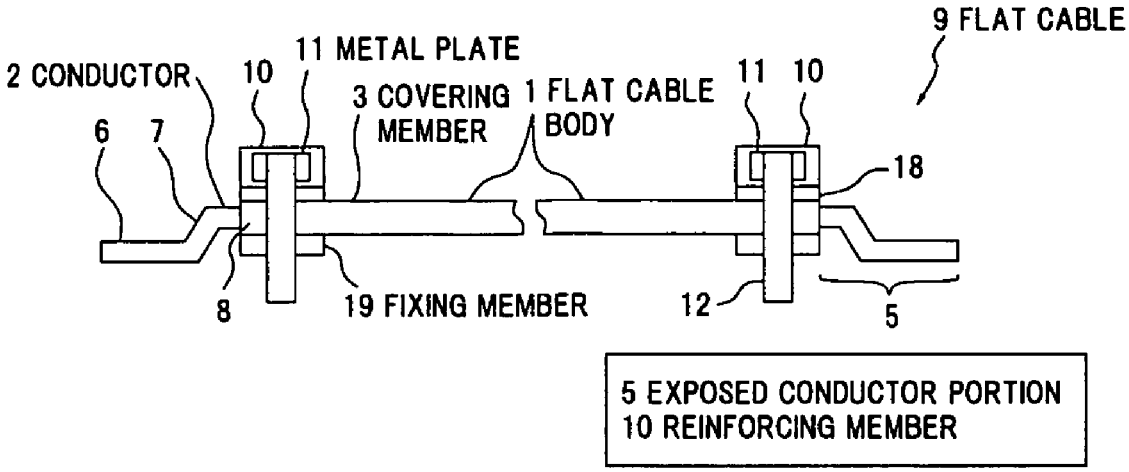
FIG. 1 is a side view showing a flat cable provided with a reinforcing member and a fixing member in the present embodiment.
Figure 2:
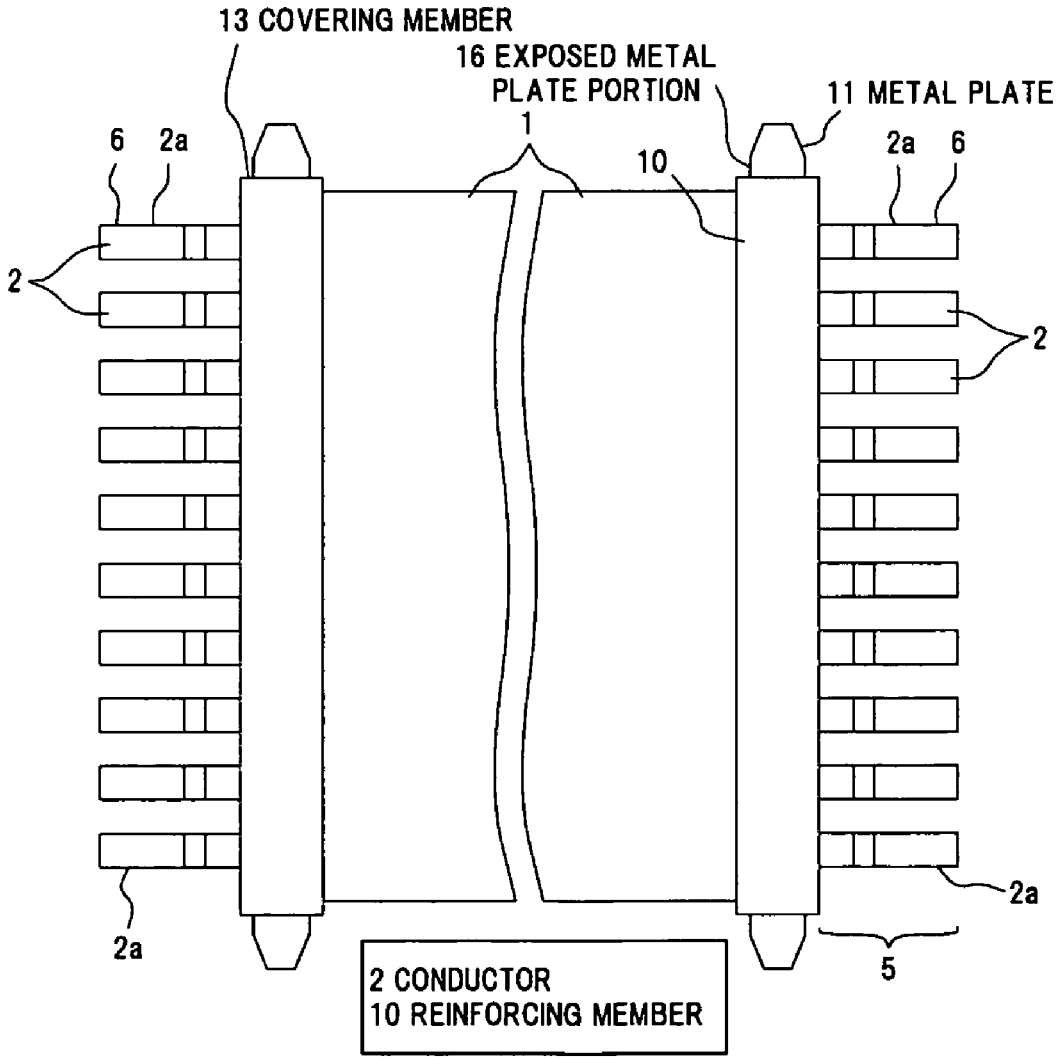
FIG. 2 is a plan view showing the flat cable shown in FIG. 1.
Figure 3:
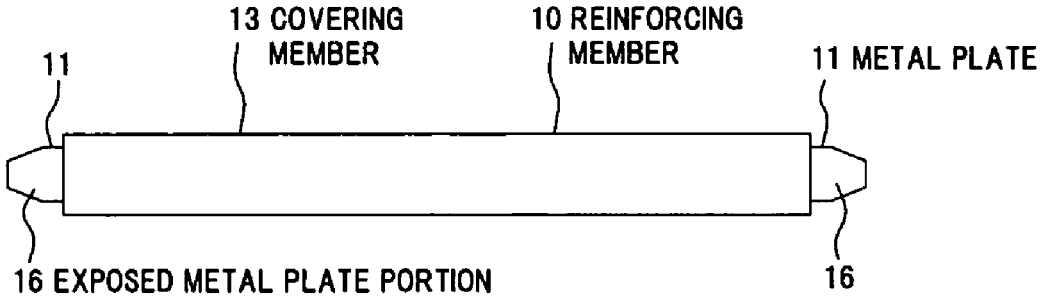
FIG. 3 is a plan view showing a reinforcing member constituting the flat cable shown in FIG. 1.
Figure 4:
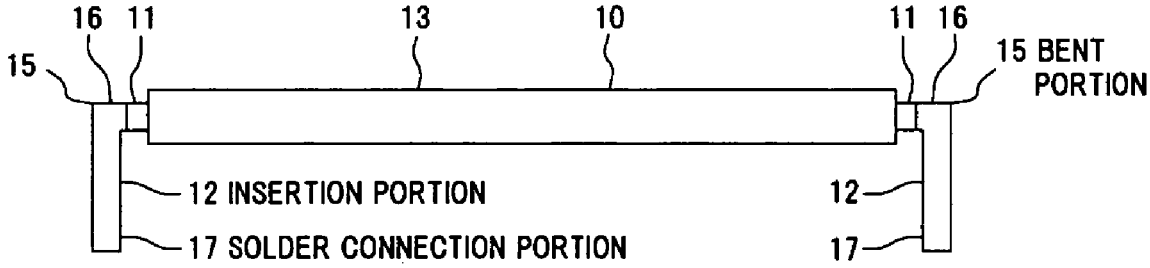
FIG. 4 is a side view showing the reinforcing member shown in FIG. 3.
Figure 5:
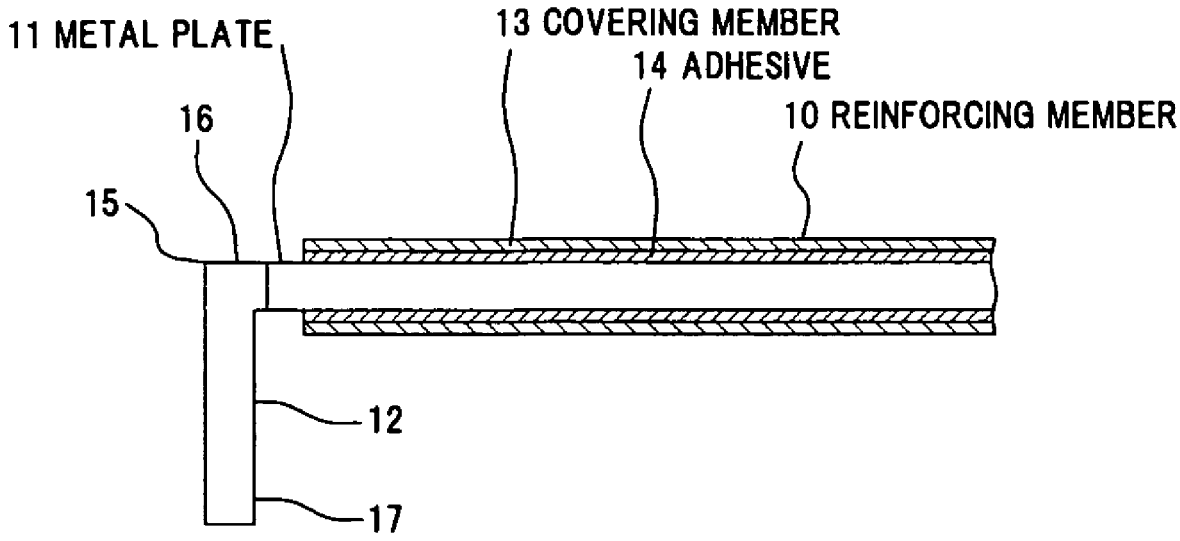
FIG. 5 is a partial cross sectional view showing an inner structure of the reinforcing member shown in FIG. 3.
Figure 6:
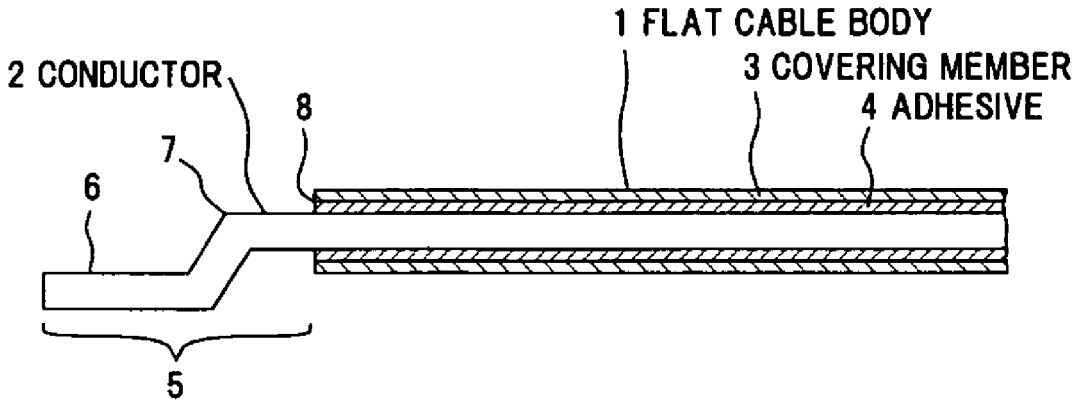
FIG. 6 is a partial cross sectional view showing an inner structure of the flat cable.

FIG. 1 is a schematic side view showing a flat cable provided with a reinforcing member and a fixing member in the present embodiment and FIG. 2 is a schematic plan view showing the flat cable shown in FIG. 1. FIG. 3 is a schematic plan view showing a reinforcing member constituting the flat cable shown in FIG. 1 and FIG. 4 is a side view showing the reinforcing member shown in FIG. 3. FIG. 5 is a schematic partial cross sectional view showing an inner structure of the reinforcing member shown in FIG. 3. FIG. 6 is a partial cross sectional view showing the inner structure of the flat cable. FIGS. 7A to 7D are partial enlarged side views showing a solder connection portion of the flat cable shown in FIG. 1.

Firstly, as shown in FIG. 1, a flat cable 9 in the present embodiment is provided with a flat cable body 1, a reinforcing member 10 for reinforcing the flat cable body 1 at the vicinity of both longitudinal end portions of the flat cable body 1, and a fixing member 19 as an example of an intervening portion for fixing an end portion of the flat cable body 1 having the reinforcing member 10 fixed thereto to a below-described printed wiring board.

The flat cable body 1 has, as shown in FIG. 6, plural conductors 2 arranged in parallel in a width direction thereof, a covering member 3 (i.e., an insulation film) for covering the plural conductors 2 between both longitudinal end portions thereof so that the both end portions are each exposed, and an adhesive 4 for bonding the plural conductors 2 to the covering member 3. The plural conductors 2 are arranged in parallel in a width direction thereof to compose a conductor group. At the both longitudinal end portions, the plural conductors 2 each have an exposed conductor portion 5 as an exposed portion which is formed by partially exposing the plural conductors 2 from the covering member 3. Each exposed conductor portion 5 of the plural conductors 2 has a bent portion 7 having an S-shape in a side view. In addition, a region of the exposed conductor portion 5 including a tip (mainly a tip portion of the exposed conductor portion 5) has a solder connection portion 6 as a conductor connecting portion which is provided connectable to an electrode portion as an external conductor provided on the printed wiring board. Then, the reinforcing member 10 and the fixing member 19 are provided on a surface of a covering member end portion 8 as an end portion of the covering member 3 located in the vicinity of the portion where the plural conductors 2 are exposed from the covering member 3 of the flat cable body 1. If there is more exposed conductor portion 5 than necessary, short circuit may occur due to a contact with other components or a housing (case) of a device on which a wiring component are mounted. Therefore, it is preferable that there be as less exposed conductor portion 5 as possible.

The reinforcing member 10 is provided in a region including an edge of the covering member 3 so as to cover each of the plural conductors 2 in a direction different from a longitudinal direction of the plural conductors 2. In other words, the reinforcing member 10 is provided to cover a portion of the conductor group along a width direction to traverse thereacross so that a center of the reinforcing member 10 is located at a predetermined distance from the edge of the covering member 3. In addition, the reinforcing member 10 is provided fixable to an external printed wiring board. Alternatively, the reinforcing member 10 may protrude from an end face of the flat cable body 1 toward the exposed conductor portion 5.

As shown in FIGS. 3 and 5, etc., the reinforcing member 10 has a metal plate 11, a covering member 13 as an insulative covering layer for covering the metal plate 11, and an adhesive 14 for bonding the metal plate 11 to the covering member 13. In addition, the reinforcing member 10 in the present embodiment has a substantially rectangular shape in a plan view, as shown in FIG. 3. The reinforcing member 10 has, e.g., a strip shape, is formed in a width direction across the conductor group in the vicinity of the solder connection portion 6 of the conductor 2 which is exposed from the flat cable body 1 (in other words, at the vicinity of the end portion of the covering member 3), and is fixed to the surface of the covering member 3 by an adhesive or a bonding agent, etc.

Where the reinforcing member 10 is constructed as described above, the metal plate 11 can be prevented from contacting the flat cable body 1 to cause a damage such as friction, abrasion or damage by pressure in the flat cable body 1 even when a mechanical load such as vibration or impact is applied to the flat cable 9 of the embodiment after the flat cable 9 is attached to a printed wiring board since the metal plate 11 is covered with the covering member 13.

In addition, the both longitudinal end portions of the reinforcing member 10 include an exposed metal plate portion 16 which is formed by partially exposing the metal plate 11 from the covering member 13. The exposed metal plate portion 16 is provided fixable to an external printed wiring board. For example, a portion of the covering member 13 is removed at the both longitudinal end portions of the reinforcing member 10, thereby exposing the surface of the metal plate 11. Thus, the exposed metal plate portion 16 is each formed at the both end portions of the reinforcing member 10. In addition, the exposed metal plate portion 16 is provided connectable to an electrode portion of the printed wiring board which is provided to correspond to each of the plural conductors 2.

A portion of the tip of the exposed metal plate portion 16 is provided fixable to the printed wiring board. For example, the exposed metal plate portion 16 is provided insertable into and fixable in a through-hole (an electrode portion having a through-hole shape) which is provided on the external printed wiring board. The exposed metal plate portion 16 is inserted into the through-hole and is then fixed thereto using a jointing material, etc.

Figure 7A:
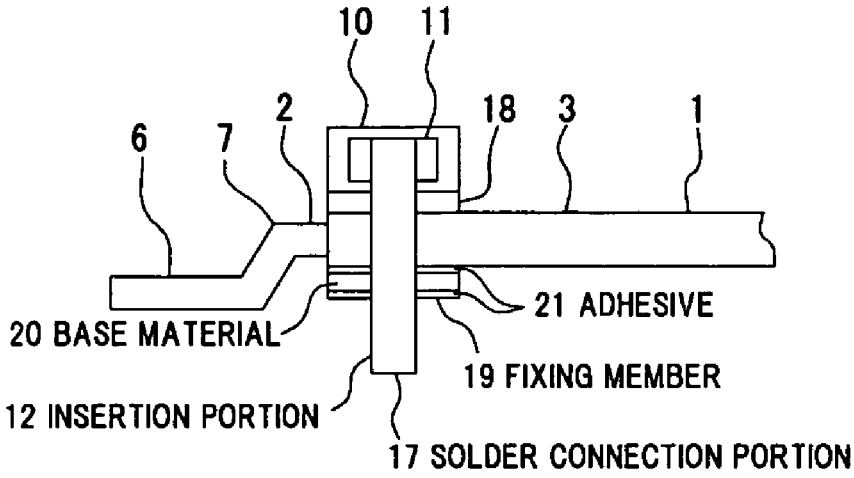
FIG. 7A is a partial enlarged side view showing a solder connection portion of the flat cable shown in FIG. 1 and FIGS. 7B to 7D are diagrams illustrating modifications of an insertion portion.
Figures 7B, 7C, 7D:
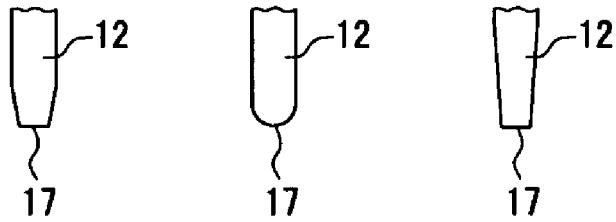

As shown in FIG. 4, in order to easily insert the exposed metal plate portion 16 into the through-hole of the printed wiring board, the exposed metal plate portion 16 can have, e.g., a bent portion 15 having a substantially right angle in a side view at a longitudinal end portion of the exposed metal plate portion 16. For example, the tip portion of the exposed metal plate portion 16 formed at the longitudinal end portion of the reinforcing member 10 is bent so as to be insertable into the through-hole of the printed wiring board, thereby forming the bent portion 15. The bent portion 15 is inserted into the through-hole and is subsequently fixed thereto using a jointing material such as solder material. An electrode portion is provided inside the through-hole and the bent portion 15 is electrically connected thereto by a jointing material such as solder material. In this case, the bent tip portion of the metal plate 11 has a function as an insertion portion 12 which is inserted into a corresponding through-hole-shaped electrode portion, etc., of the printed wiring board, and the tip portion of the insertion portion 12 has a solder connection portion 17 which is connected to the through-hole-shaped electrode portion. In addition to a straight shape as shown in FIG. 7A, the insertion portion 12 may have a tapered shape in the vicinity of the solder connection portion 17 as shown in FIG. 7B or may have an arc-shaped solder connection portion 17 as shown in FIG. 7C, or a region including the solder connection portion 17 may be tapered with a gentle inclination as shown in FIG. 7D. The shapes of the insertion portion 12 shown in FIG. 7B to 7D facilitate insertion into the through-hole provided on the printed wiring board.

As shown in FIG. 2, the reinforcing member 10 is arranged on an upper surface of the flat cable body 1 (i.e., on a side not facing the printed wiring board (hereinafter referred to as "a non-facing side")) so that the longitudinal direction of the reinforcing member 10 is orthogonal to that of the plural conductors 2. In addition, the reinforcing member 10 is provided on the surface of the covering member end portion 8 of the flat cable body 1 to cover the plural conductors 2. The exposed metal plate portion 16 of the reinforcing member 10 is exposed from the covering member 13 beyond a conductor 2*a* which is located at an edge in an array direction of the parallel arranged conductors 2. In addition, the exposed metal plate portion 16 has the bent portion 15 bent toward a lower side of the flat cable body 1 (i.e., a side facing the printed wiring board (hereinafter referred to as "a facing side")). The reinforcing member 10 is fixed by an adhesive member 18 to the surface of the covering member 3 on the upper side of the flat cable body 1 in the vicinity of the covering member end portion 8 of the flat cable body 1. An epoxy resin, a silicone resin or an acrylic resin, etc., is applied as an adhesive and is cured to form the adhesive member 18. The adhesive member 18 is preferably formed to be thin unless a function of bonding the reinforcing member 10 to the flat cable body 1 is impaired. Meanwhile, the adhesive member 18 may be provided to a portion of the reinforcing member 10 but is preferably provided over the entire reinforcing member 10 from the viewpoint of preventing the interface from separating.

As shown in FIG. 7A, the fixing member 19 has a film-like base material 20 and an adhesive 21 formed on both upper and lower surfaces of the film-like base material 20. Similarly to the reinforcing member 10, the fixing member 19 has a substantially rectangular shape in a plan view (not shown). The fixing member 19 has, e.g., a strip shape (not shown). In addition, the fixing member 19 is arranged on the lower surface of the flat cable body 1 so that the longitudinal direction thereof is orthogonal to that of the plural conductors 2, and is provided in the vicinity of the covering member end portion 8 of the flat cable body 1. In other words, the fixing member 19 is arranged substantially within a projection plane of the reinforcing member 10. The fixing member 19 is fixed, by the adhesive 21 provided on the upper side thereof, to the surface of the covering member 3 on the lower side of the flat cable body 1. Another adhesive 21 provided on the lower side has a function of fixing the fixing member 19 to the surface of the printed wiring board when attaching the flat cable 9 thereto. The adhesive 21 can be formed of, e.g., an epoxy resin, a silicone resin or an acrylic resin, etc. It is preferable that the base material 20 be thinner than the adhesive 21. The fixing member 19 should have properties less likely to deform, in detail, preferably has high elastic modulus, considering the function of the fixing member 19. Since the base material 20 has generally higher elastic modulus than the adhesive 21, use of the base material 20 as the fixing member 19 allows the decrease in the elastic modulus of the entire fixing member 19 to be suppressed.

Where the fixing member 19 is constructed as described above, the flat cable body 1 can be prevented from lifting from the printed wiring board at the middle portion in the width direction of the flat cable body 1 even when a mechanical load such as vibration or impact is applied to the flat cable 9 of the embodiment since the flat cable 9 is fixed to the surface of the printed wiring board by the adhesive 21.

Example of Attaching Flat Cable to Printed Wiring Board

Attachment of the flat cable 9 in the present embodiment to the printed wiring 25, board will be described referring to FIGS. 8 and 9.

Figure 8:
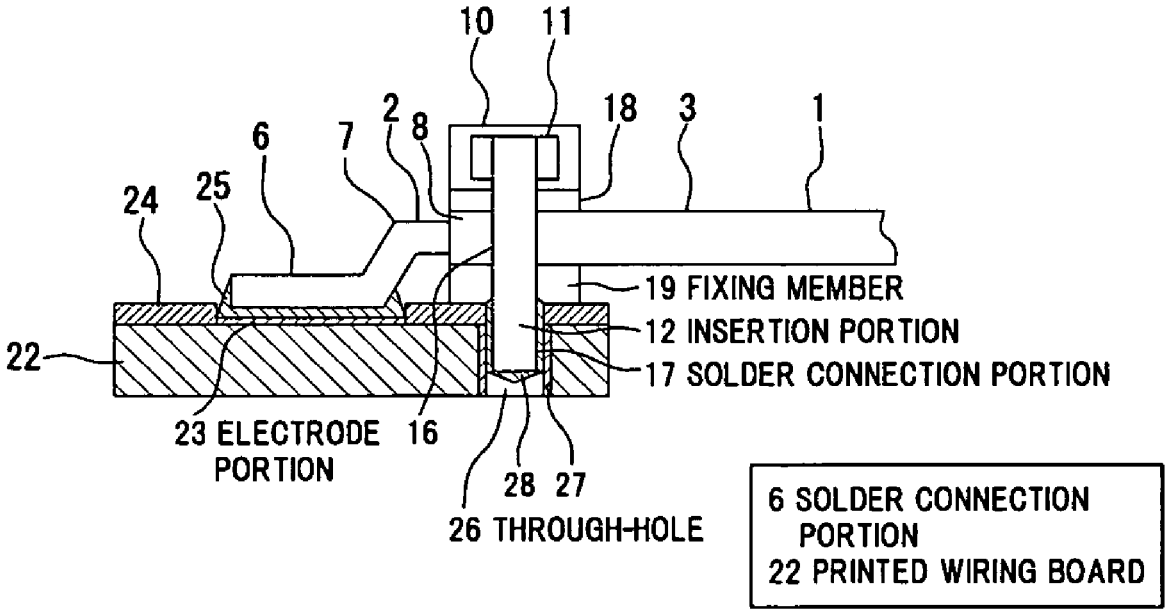
FIG. 8 is a partial cross sectional view showing a state that the flat cable shown in FIG. 1 is attached to a printed wiring board.
Figure 9:
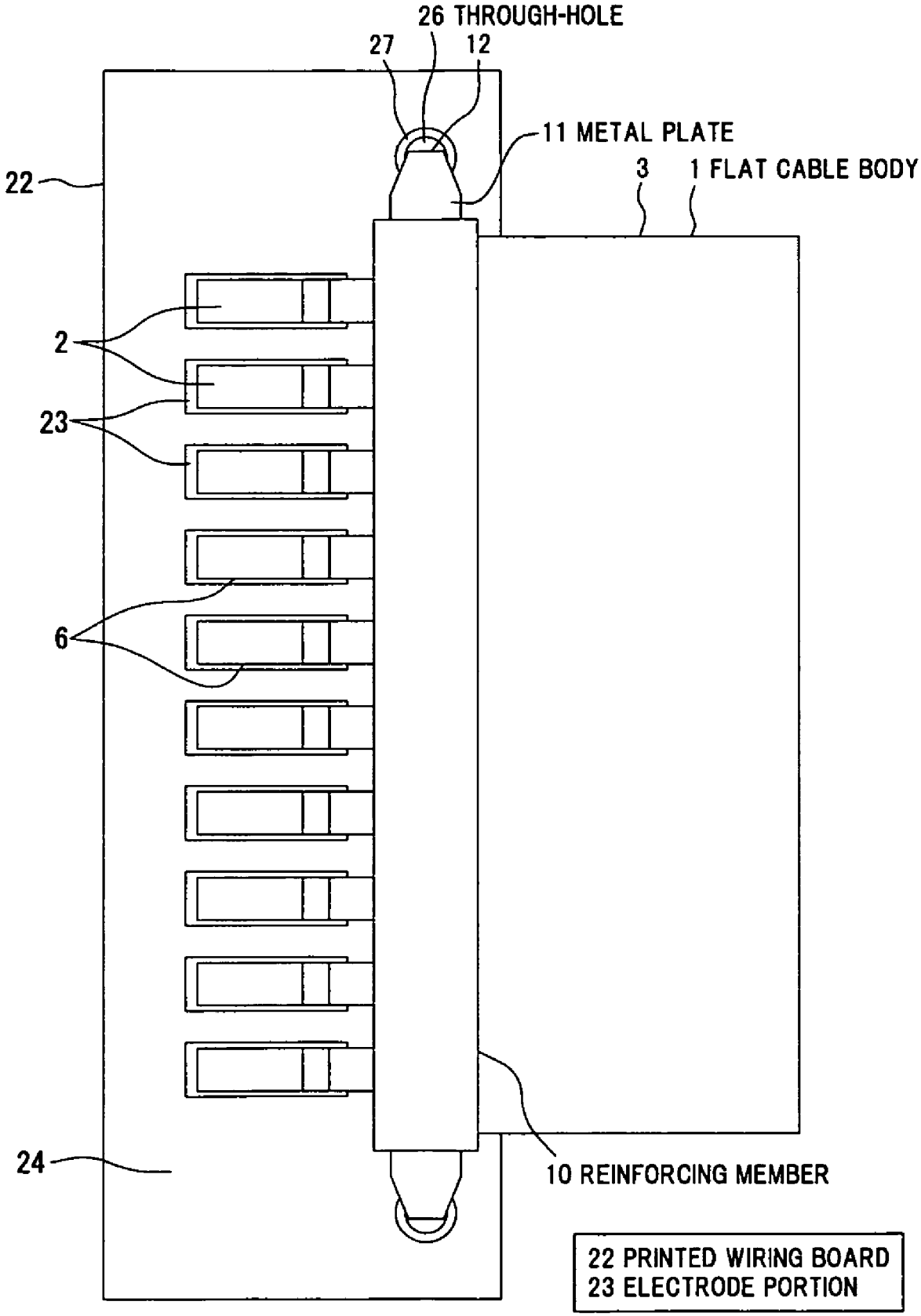
FIG. 9 is a plan view showing the state shown in FIG. 8 that the flat cable is attached.
Figure 10:
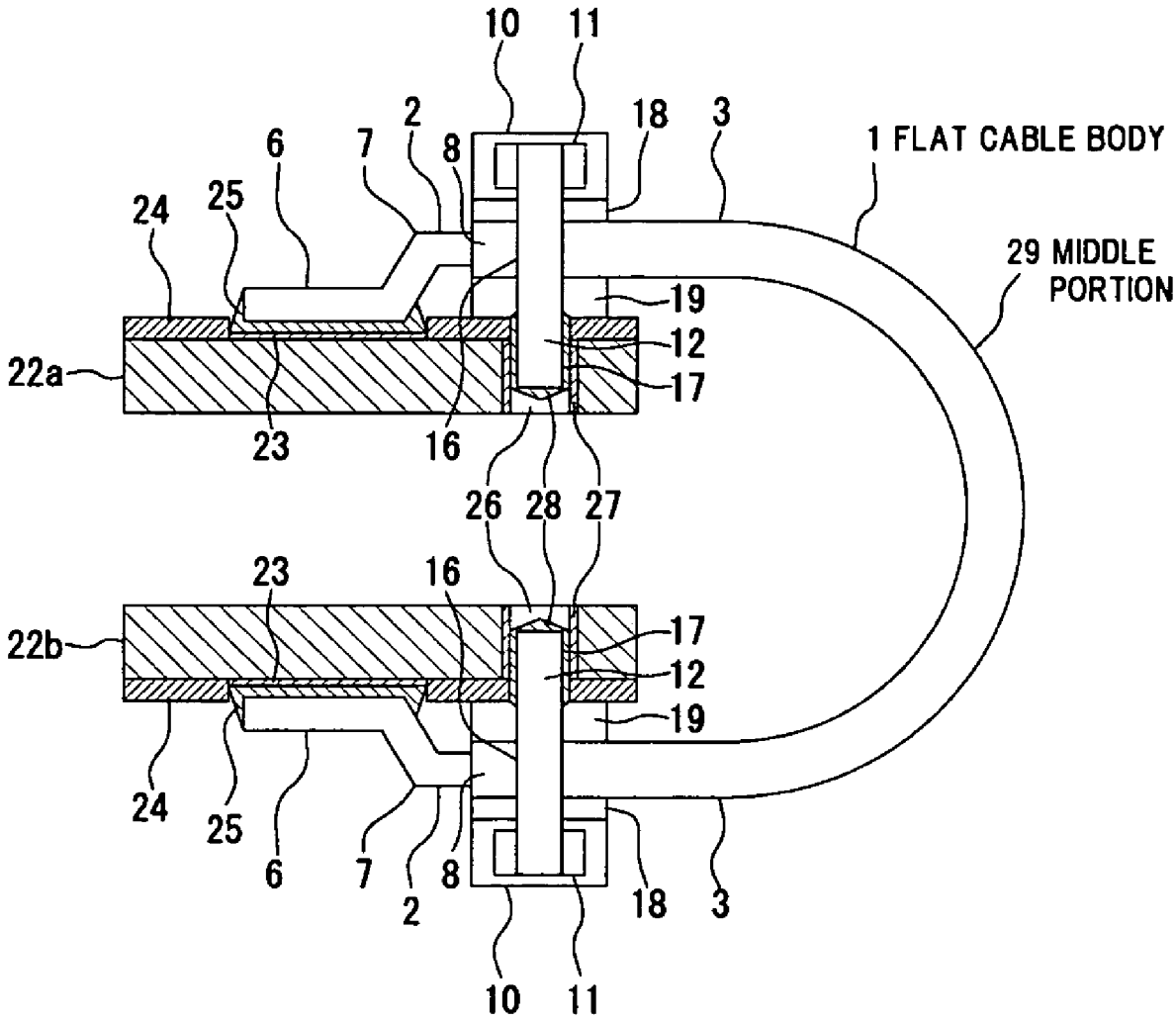
FIG. 10 is a cross sectional view showing a state that the flat cable shown in FIG. 1 is attached so as to connect two printed wiring boards.

FIG. 8 is a schematic partial cross sectional view showing a state that the flat cable shown in FIG. 1 is attached to a printed wiring board, and FIG. 9 is a schematic plan view showing the state shown in FIG. 8 that the flat cable is attached. In addition, FIG. 10 is a schematic cross sectional view showing a state that the flat cable shown in FIG. 1 is attached so as to connect two printed wiring boards.

The solder connection portion 6 at the tip portion of the exposed conductor portion 5 of the plural conductors 2 included in the flat cable body 1 is joined to an electrode portion 23 of a printed wiring board 22. Plural electrode portions 23 respectively corresponding to the plural solder connection portions 6 are provided on the printed wiring board 22. The electrode portion 23 is exposed on the surface of the printed wiring board 22 from a solder resist 24 having electrical insulation, and is joined to each solder connection portion 6 of the plural conductors 2 so as to be electrically conductive therewith.

The insertion portion 12 exposed from the covering member 13 of the reinforcing member 10 is inserted into a through-hole 26 provided on the printed wiring board 22 and is joined to a through-hole electrode portion 27 provided on an inner surface of the through-hole 26 by a joining material 28 such as solder material. Meanwhile, the fixing member 19 is fixed to the surface of the printed wiring board 22 by an adhesive (not shown).

FIGS. 8 and 9 show an example in which one terminal end of the flat cable 9 in the present embodiment is attached to the printed wiring board 22. Another terminal end of the flat cable 9 is also attached to the printed wiring board 22 in the same manner. The flat cable 9 is attached at the both terminal ends to the printed wiring board 22, e.g., in a state of being curved in a middle portion 29 of the flat cable body 1 as shown in FIG. 10 for the purpose of connecting two stacked printed wiring boards 22*a* and 22*b* each other.

When mechanical vibration is applied to a device mounting the attached component of the printed wiring board with the flat cable as shown in FIG. 10, high-amplitude vibratile deformation of the conductor 2 of the flat cable in a thickness direction (i.e., a vertical direction in FIG. 10) may occur in the flat cable body 1 itself connecting printed wiring boards due to resonance. The vibratile deformation acts intensively on the solder connection portion 6 of the flat cable body 1 as a fixed end and generates high stress in the solder connection portion 6 at the upper end portion or in the conductor 2 at the covering member end portion 8.

The reinforcing member 10 provided in the vicinity of the covering member end portion 8 included in the flat cable body 1 is composed of the metal plate 11 and the covering member 13 for covering the metal plate 11 in a layered manner. The reinforcing member 10 has rigidity to sufficiently suppress deformation of the flat cable body 1 in the vicinity of the covering member end portion 8, and for example, a material having strength higher than that of the conductor 2 of the flat cable body 1 is used as a material constituting the metal plate 11. The vibratile deformation in the vicinity of the solder connection portion 6 is suppressed by the reinforcing member 10, which allows concentration of high stress to be dispersed. Furthermore, the tip portion of the exposed metal plate portion 16 is inserted into the through-hole 26 of the printed wiring board 22 and is joined to the through-hole electrode portion 27 at the solder connection portion 17, and the reinforcing member 10 is thereby fixed to the printed wiring board 22. By fixing the flat cable body 1 via the reinforcing member 10 to the printed wiring board 22 which is thicker than the flat cable body 1 or the reinforcing member 10 (e.g., about not less than 1.0 mm and not more than 1.6 mm) and has high rigidity, the vibratile deformation of the flat cable body 1 in the vicinity of the solder connection portion 6 is restricted by the printed wiring board 22 and a deformation amount in the vicinity of the solder connection portion 6 is significantly reduced.

In addition, the fixing member 19 provided substantially within the projection plane of the reinforcing member 10 so as to fill the gap between the flat cable body 1 and the printed wiring board 22 makes the printed wiring board 22 strongly restrict the flat cable body 1 and allows further reduction of a deformation amount in the vicinity of the solder connection portion 6. In other words, the movement of the flat cable body 1 deforming toward the printed wiring board 22 facing thereto can be suppressed by the fixing member 19, and it is thus possible to reduce the deformation amount in the vicinity of the solder connection portion 6.

The fixing member 19 in the present embodiment is bonded and fixed to the flat cable body 1 as well as the printed wiring board 22 by the adhesive 21. The adhesive 21 is softened at a high temperature, which may decrease a deformation restricting effect. Therefore, the adhesive 21 is preferably formed of a material having a high glass-transition temperature. Meanwhile, the end portion of the exposed metal plate portion 16 constituting the reinforcing member 10 having rigidity higher than the flat cable body 1 is fixed to the printed wiring board. Due to the restricting action of the reinforcing member 10, the deformation amount of the flat cable body 1 in the vicinity of the solder connection portion 6 does not significantly increase even when the adhesive 21 of the fixing member 19 is softened under high temperature environment.

In addition, by attaching the flat cable 9 provided with the reinforcing member 10 as well as the fixing member 19 to the printed wiring board 22, it is possible to suppress deformation generated in the vicinity of the solder connection portion 6 of the flat cable body 1 which connects the printed wiring boards as shown in FIG. 10, and it is possible to suppress high stress concentration in the solder connection portion 6 at the upper end portion or in the conductor 2 at the covering member end portion 8.

The flat cable 9 in the present embodiment shown in FIGS. 1 and 8, etc., has the fixing member 19 which is interposed between the flat cable body 1 and the printed wiring board 22. Therefore, the S-shaped bent portion 7 is provided to the exposed conductor portion 5 of the conductor 2 to allow the solder connection portion 6 to be connected to the corresponding electrode portion 23 of the printed wiring board 22. In addition, since the exposed conductor portion 5 is connected to the electrode portion 23 of the printed wiring board by bending the conductor 2, it is possible to press the bottom (a surface facing the printed wiring board) of the solder connection portion 6 of the conductor 2 against the electrode portion 23 and it is thus possible to prevent a gap therebetween from unnecessarily widening. Controlling the gap allows generation and remaining of voids in solder to be suppressed at the time of connection using a solder material. Since suppression of void allows the stress concentration due to the presence of void to be suppressed even when mechanical load such as vibration acts on the solder connection portion 6, it is possible to prevent damage to the solder connection portion 6.

Meanwhile, since the S-shaped bent portion 7 is provided to the exposed conductor portion 5 of the conductor 2, the bent portion 7 may be deformed at the time of attaching the flat cable body 1 to the printed wiring board 22 when an excessive pressing force is applied thereto from above the flat cable body 1. High stress is generated in the solder connection portion 6 at the upper end portion or in the conductor at the covering member end portion 8 due to the deformation, which may cause damage thereto. In the flat cable 9 and the connection structure of the present embodiment, the fixing member 19 which fills the gap between the flat cable body 1 and the printed wiring board 22 is provided in the vicinity of the covering member end portion 8. Since the fixing member 19 presses the flat cable body 1 toward the printed wiring board 22, it is possible to suppress excessive load acting on the bent portion 7 of the conductor 2. As a result, it is possible to prevent the conductor 2 from being damaged.

Furthermore, in a structure body in which the flat cable body 1 is attached to the printed wiring board 22, static or dynamic mechanical load is applied to a portion of the conductor 2 in the vicinity of the solder connection portion 6 depending on handling for conveyance or a handling method for attachment during the manufacturing processes from immediately after attachment to mounting on a device, and the conductor 2 in the vicinity of the solder connection portion 6 may be damaged. In the flat cable 9 and the connection structure of the present embodiment, since the portion in the vicinity of the solder connection portion 6 is reinforced by the reinforcing member 10 against such mechanical load and the reinforcing member 10 is firmly fixed to the printed wiring board 22, it is possible to suppress the mechanical load applied to the portion in the vicinity of the solder connection portion 6. As a result, it is possible to prevent the conductor in the vicinity of the solder connection portion 6 from being damaged.

In addition, in the flat cable 9 and the connection structure of the present embodiment, the exposed metal plate portion 16 formed at the both end portion of the strip-shaped reinforcing member 10 is bent as shown in FIGS. 8 and 9. Then, the insertion portion 12 provided at the tip portion of the exposed metal plate portion 16 is inserted into the through-hole 26 of the printed wiring board 22. As a result, positioning of the plural conductors 2 with respect to the plural electrode portions 23 of the printed wiring board 22 provided respectively corresponding to the plural conductors 2 can be facilitated and accurate when the flat cable body 1 is attached to the printed wiring board 22.

A method of attaching the flat cable 9 in the present embodiment to the printed wiring board 22 will be described below.

Jointing materials 25 and 28 such as paste solder material are applied to the surface of the electrode portion 23 and the inside of the through-hole 26 of the printed wiring board 22 by a printing method using a metal mask or a dispensing method. The insertion portion 12 of the reinforcing member 10 of the flat cable 9 is inserted into the through-hole 26 of the printed wiring board 22, and the solder connection portion 6 of the conductor 2 is placed on the electrode portion 23 of the printed wiring board 22 in a state that the position thereof is determined.

In this case, the flat cable 9 connects two printed wiring boards (e.g., the printed wiring boards 22*a* and 22*b* of FIG. 10). In detail, the solder connection portion 6 on one end of the flat cable 9 is placed on the electrode portion 23 of one printed wiring board, and the insertion portion 12 on the one end of the flat cable 9 is inserted into the through-hole 26 of the one printed wiring board. Likewise, the solder connection portion 6 on another end of the flat cable 9 is placed on the electrode portion 23 of another printed wiring board, and the insertion portion 12 on the other end of the flat cable 9 is inserted into the through-hole 26 of the other printed wiring board.

In addition, the flat cable body 1 is fixed to the printed wiring board 22 by the fixing member 19 which is provided in the vicinity of the covering member end portion 8. Handling and conveyance to a belt conveyor of a solder reflow oven are carried out in this state, and the jointing materials 25 and 28 such as solder material are molten and solidified while being moved in the reflow oven by the belt conveyor. As a result, the solder connection portion 6 of the conductor 2 is joined to the electrode portion 23 and the solder connection portion 17 of the insertion portion 12 is joined to the through-hole electrode portion 27.

The plural conductors 2 of the flat cable body 1 are formed of a copper alloy material such as oxygen-free copper or tough pitch copper. A plating process can be performed on the surface of the copper alloy material. As a plating material, it is possible to use a metal material selected from the group consisting of, e.g., tin (Sn), nickel (Ni) and silver (Ag). In addition, it is possible to form a single or plural metal layers on the surface of the copper alloy material by the plating process. Meanwhile, it is possible to use a film-like polyimide resin as the covering member 3. Then, it is possible to use an epoxy resin as the adhesive 4.

It is preferable that the metal plate 11 of the reinforcing member 10 be formed of a material having strength higher than that of the conductor 2. The metal plate 11 can be formed of a material such as, e.g., phosphor bronze or iron (Fe)-nickel (Ni) alloy. In addition, the plating process can be performed on the surface of the metal plate 11. For the covering member 13 of the reinforcing member 10, it is possible to use a polyimide resin, a polyamide resin, a fluorine resin (PTFE or PFA, etc.), a polyaminobismaleimide resin or a polyethylene terephthalate resin, etc. For the adhesive 14, it is possible to use an epoxy resin, a silicone resin or an acrylic resin, etc. Furthermore, the metal plate 11 of the reinforcing member 10 can be formed of the same material as the conductor 2 of the flat cable body 1. In this case, the metal plate 11 is formed thicker than the conductor 2 in order to improve rigidity of the metal plate 11.

The base material 20 of the fixing member 19 can be formed of a polyimide resin film. Meanwhile, it is possible to use a silicone resin, an acrylic resin or an epoxy resin, etc., as the adhesive 21 which is provided on both the upper and lower surfaces of the base material 20.

In addition, a solder material such as Sn-3Ag-0.5Cu (mass %) having a melting temperature of about 218° C. or Sn-3.5Ag (mass %) having a melting temperature of about 221° C. can be used as the jointing material 25 which connects the conductor 2 to the electrode portion 23 of the printed wiring board 22. It is possible, to use the same solder materials for connecting the insertion portion 12 of the reinforcing member 10 to the through-hole electrode portion 27 of the printed wiring board 22.

Effects of the Embodiment

Since the flat cable 9 in the present embodiment has the reinforcing member 10 provided in a near-field region of the solder connection portion 6 (i.e., an edge of the insulation film where the conductor group is exposed, and an upper end portion of the solder fillet formed on the solder connection portion 6) which is formed by joining the solder connection portion 6 of the exposed conductor portion 5 of the flat cable body 1 to the electrode portion 23 of the printed wiring board 22 using a solder material, etc., it is possible to suppress deformation in the near-field region (especially to suppress the deformation amount of the conductor 2 of the flat cable body 1 in a thickness direction) when mechanical load is applied to the near-field region of the solder connection portion 6. This allows the flat cable 9 to reduce stress generated in the conductor 2 of the flat cable body 1 located in the near-field region of the solder connection portion 6 and in the joining material such as solder material.

The flat cable 9 in the present embodiment is provided with the reinforcing member 10. In addition, the reinforcing member 10 is composed of the strip-shaped metal plate 11 and the covering member 13 as an insulative covering layer for covering the metal plate 11. It is possible to improve rigidity of the reinforcing member 10 by forming a center region thereof using the metal plate 11. In addition, it is also possible to improve rigidity in the vicinity of the solder connection portion 6 of the conductor 2 of the flat cable body 1 to which the reinforcing member 10 is fixed. A stress generated in portions having significantly different rigidities, in the conductor portion at the edge of the insulation film constituting the flat cable body 1 and in the conductor portion at the upper edge of the solder fillet, by mechanical load applied thereto can be reduced by improving the rigidity in the vicinity of the solder connection portion 6. In other words, even if mechanical load such as vibration or impact is applied to a device mounting the printed wiring board 22 to which the flat cable 9 is attached, the deformation amount in the vicinity of the solder connection portion 6 caused by vibration of the flat cable itself in a plate thickness direction can be reduced, hence, it is possible to reduce stress generated in the conductor of the flat cable.

In addition, the reinforcing member 10 has the exposed metal plate portion 16. The exposed metal plate portion 16 is fixed to an electrode portion (e.g., a through-hole-shaped electrode portion) of the printed wiring board 22 by a solder material or a conductive joining material. Since the reinforcing member 10 is fixed to the printed wiring board 22 having rigidity higher than the flat cable body via the exposed metal plate portion 16, it is possible to restrict the deformation in the vicinity of the solder connection portion 6 by the reinforcing member 10 as well as by the printed wiring board 22. As a result, it is possible to further reduce deformation in the vicinity of the solder connection portion 6. Since damage to the conductor or the solder material occurring in the vicinity of the solder connection portion 6 of the conductor 2 of the flat cable body 1 can be suppressed by forming the reinforcing member 10 and fixing the reinforcing member 10 to the printed wiring board 22 as described above, it is possible to provide a robust flat cable 9.

In addition, the reinforcing member 10 is fixed to the printed wiring board 22 by inserting the bent portion 15 of the exposed metal plate portion 16 into the through-hole 26 of the printed wiring board 22 and then joining by a joining material. This facilitates positioning of the plural conductors 2 of the flat cable body 1 with respect to the electrode portions 23 of the printed wiring board 22 respectively corresponding thereto when the flat cable 9 is attached to the printed wiring board 22.

Meanwhile, the flat cable 9 in the present embodiment is provided with the fixing member 19 as an example of an intervening portion between the surface of the insulation film and the surface of the printed wiring board 22, and the fixing member 19 is fixed to the surface of the insulation film by an adhesive, etc., and is integrated with the flat cable body 1. Therefore, the flat cable 9 in the present embodiment allows the number of parts to be reduced as compared to a conventional cable, and allows the gap between the surface of the insulation film and the surface of the printed wiring board 22 to be filled by the fixing member 19 while performing the process of attaching the flat cable 9 to the printed wiring board 22.

Alternatively, it is possible to fix the fixing member 19 to both the insulation film and the printed wiring board 22. As a result, deformation in a direction to narrow the gap between the flat cable 9 and the printed wiring board 22 can be easily suppressed. However, when a non-bonded (or non-joined) portion is present between the surface of the fixing member 19 and the surface of the insulation film or between the surface of the fixing member 19 and the surface of the printed wiring board 22, an effect on deformation in a direction to widen the gap cannot be obtained. Therefore, for the purpose of improving the effect of suppressing the deformation due to the reinforcing member 10, it is preferable that the fixing member 19 be fixed to both the surface of the insulation film and the surface of the printed wiring board 22.

In addition, in the connection structure of the present embodiment, the reinforcing member 10 (e.g., having a strip shape) traversing across the conductor group in the width direction of the conductors is provided in the vicinity of the solder connection portion 6 formed by joining a conductor connecting portion to the electrode portion 23, and a portion of the reinforcing member 10 is fixed to the printed wiring board 22. As a result, the deformation amount in the vicinity of the solder connection portion 6 caused by mechanical load applied thereto can be reduced, and it is thus possible to suppress stress generated in the conductor 2 of the flat cable 9 and in the solder. Furthermore, the fixing member 19 is provided between the surface of the printed wiring board 22 and the surface of the insulation film facing thereto, and is fixed to both the printed wiring board 22 and the insulation film. As a result, it is possible to fill physical space (gap) required for the conductor 2 of the flat cable 9 to deform in a thickness direction of the conductor plate and it is possible to fix the flat cable 9 to the printed wiring board 22 by the fixing member 19, hence, it is possible to further reduce deformation of the conductor 2 of the flat cable 9 generated in the vicinity of the solder connection portion 6.

In addition, in the connection structure of the present embodiment, since the conductor 2 exposed at the end of the flat cable is directly connected to the electrode portion 23 of the printed wiring board 22 by a conductive joining material, high resistance against mechanical load such as vibration or impact is exerted.

Modification of the Embodiment

Figure 11:
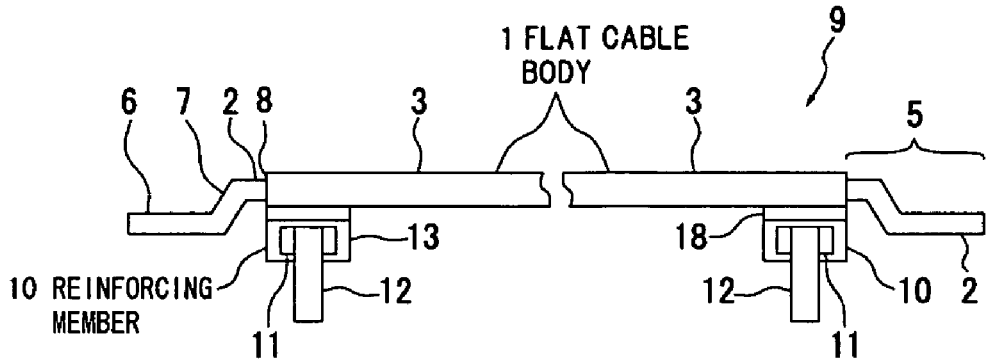
FIG. 11 is a side view showing another configuration of the flat cable in the present embodiment provided with a reinforcing member and a fixing member.
Figure 12:
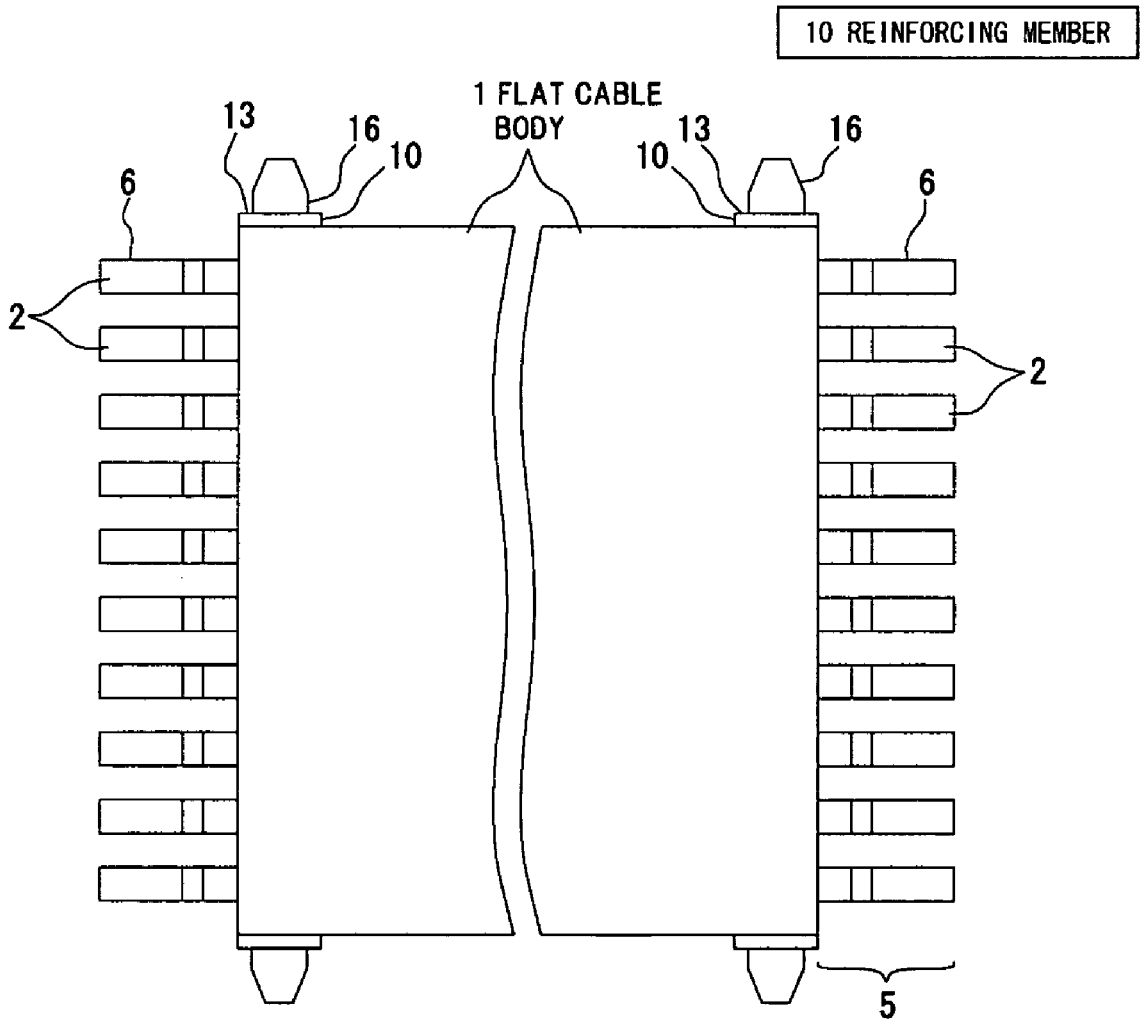
FIG. 12 is a plan view showing the flat cable shown in FIG. 11.

FIG. 11 is a schematic side view showing another configuration of the flat cable in the present embodiment provided with a reinforcing member and a fixing member, and FIG. 12 is a schematic plan view showing the flat cable shown in FIG. 11.

The flat cable 9 shown in FIG. 11 is provided with substantially the same configuration and function as the flat cable 9 in the present embodiment shown in FIGS. 1 and 2, except that the reinforcing member 10 is provided on a lower surface of the flat cable body 1 (a surface facing the printed wiring board 22) as shown in FIG. 11. Therefore, detailed explanations will be omitted except for the difference.

The strip-shaped reinforcing member 10 is provided to cover the plural conductors 2 at the covering member end portion 8 of the flat cable body 1. The exposed metal plate portion 16 of the metal plate 11 is provided at both end portions of the reinforcing member 10, where the metal plate 11 is bent at a substantially right angle and the tip portion thereof becomes the insertion portion 12 to be inserted into the through-hole 26 of the printed wiring board 22. The reinforcing member 10 is fixed by the adhesive member 18 to the surface of the covering member 3 on the lower side of the flat cable body 1 in the vicinity of the covering member end portion 8 of the flat cable body 1.

The state that the flat cable 9 in a modification of the present embodiment shown in FIG. 11 is attached to the printed wiring board 22 will be described referring to FIG. 13.

Figure 13:
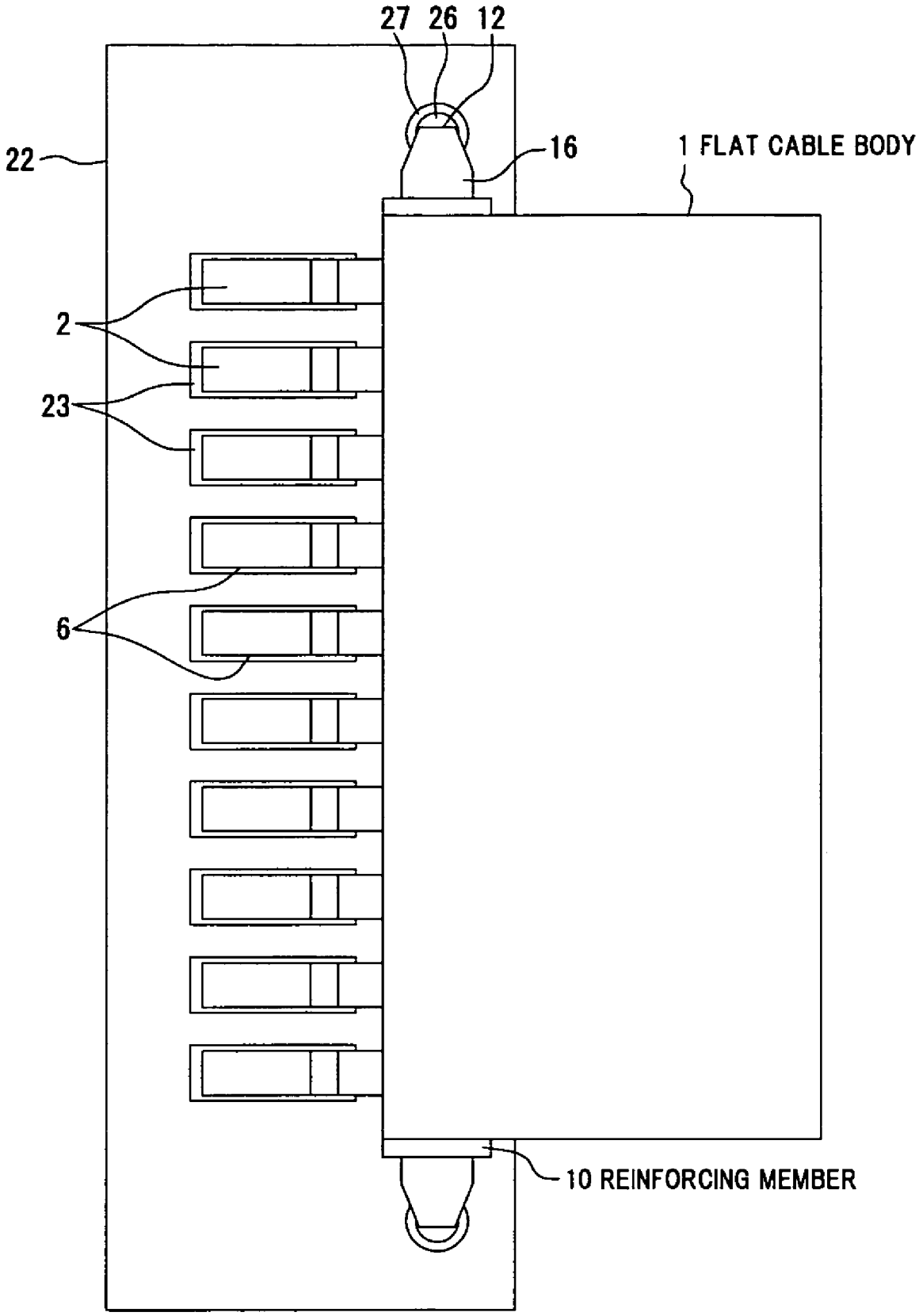
FIG. 13 is a plan view showing a state that the flat cable shown in FIG. 11 is attached to a printed wiring board.

FIG. 13 is a schematic plan view showing a state that the flat cable shown in FIG. 11 is attached to a printed wiring board.

The solder connection portion 6 at the tip of the conductor 2 of the flat cable body 1 is placed on the electrode portion 23 of the printed wiring board 22 and is joined by a jointing material such as solder material. The insertion portion 12 of the reinforcing member 10 is inserted into the through-hole 26 of the printed wiring board 22 and is joined to the through-hole electrode portion 27 formed on the inner surface of the through-hole 26 by a joining material such as solder material.

Similarly to the flat cable 9 in the present embodiment shown in FIGS. 1 and 2, etc., the flat cable 9 in the modification of the present embodiment also allows vibratile deformation in the vicinity of the solder connection portion 6 to be suppressed by the reinforcing member 10 provided in the vicinity of the covering member end portion 8 of the flat cable body 1 and concentration of high stress to be dispersed. In addition, it is possible to fix the reinforcing member 10 to the printed wiring board 22 by inserting the insertion portion 12 of the reinforcing member 10 into the through-hole 26 of the printed wiring board 22 and then joining therebetween by a solder material, etc. Thus, the vibratile deformation of the flat cable body 1 in the vicinity of the solder connection portion 6 is restricted by the printed wiring board 22, and it is possible to significantly reduce the deformation amount in the vicinity of the solder connection portion 6.

Meanwhile, in the modification of the embodiment, the reinforcing member 10 itself has a function of filling the gap between the flat cable body 1 and the printed wiring board 22 in the vicinity of the covering member end portion 8, which allows the deformation of the flat cable body 1 toward the printed wiring board 22 facing thereto to be suppressed. As described above, since it is possible to suppress deformation of the flat cable body 1 in the vicinity of the solder connection portion 6, generation of high stress in the solder connection portion 6 at the upper end portion or in the conductor 2 at the covering member end portion 8 can be suppressed.

In addition to the effect of suppressing stress in the vicinity of the solder connection portion 6, it is possible to reduce the height (or thickness) of the solder connection portion 6 after attachment to the printed wiring board 22 when the reinforcing member 10 is provided between the flat cable body 1 and the printed wiring board 22 as is the modification of the embodiment, which facilitates downsizing and thinning of a device which mounts the cable.

Another Modification of the Embodiment

Figure 14:
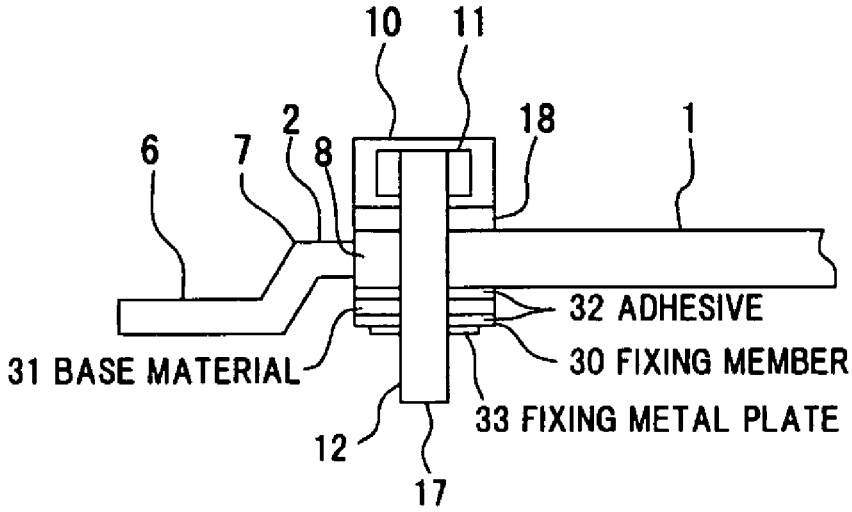
FIG. 14 is a side view showing still another configuration of the flat cable in the present embodiment provided with a reinforcing member and a fixing member.
Figure 15:
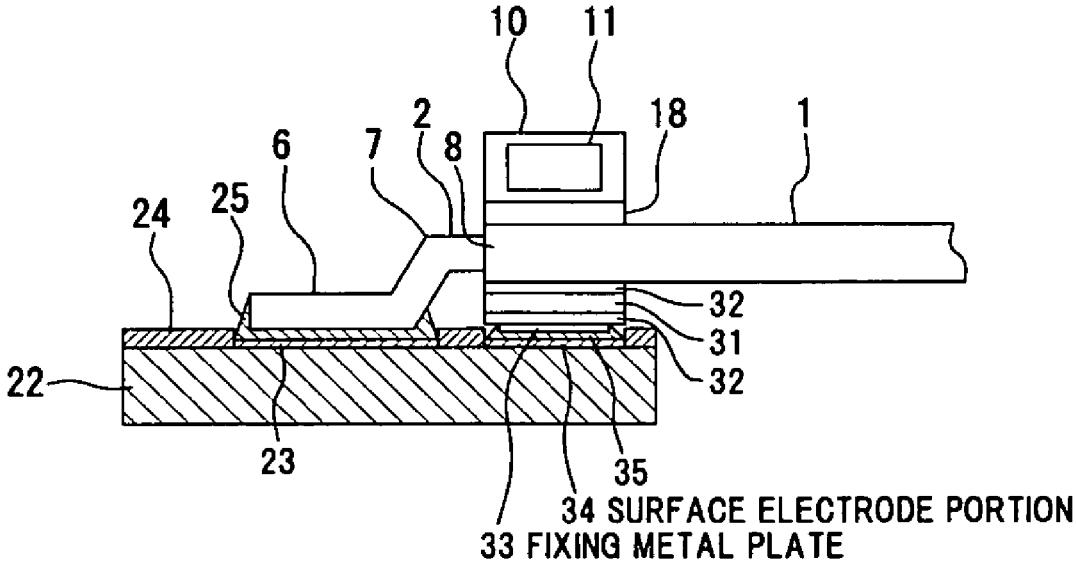
FIG. 15 is a partial cross sectional view showing a state that the flat cable shown in FIG. 14 is attached to a printed wiring board.

FIG. 14 is a schematic side view showing still another configuration of the flat cable in the present embodiment provided with a reinforcing member and a fixing member, and FIG. 15 is a schematic partial cross sectional view showing a state that the flat cable shown in FIG. 14 is attached to a printed wiring board. It should be noted that FIG. 15 shows the reinforcing member 10 without the exposed metal plate portion 16.

The configuration of the flat cable body 1 and the configuration of the reinforcing member 10 which is provided on the upper surface of the flat cable body 1 (i.e., on a surface not facing the printed wiring board (a non-facing surface)) in the vicinity of the covering member end portion 8 of the flat cable body 1 are the same as the present embodiment shown in FIGS. 1 and 8, etc.

A difference from the flat cable 9 in the present embodiment is that a strip-shaped fixing member 30 as an example of an intervening portion arranged substantially within a projection plane of the reinforcing member 10 in the vicinity of the covering member end portion 8 of the flat cable body 1 so as to fill the gap between the flat cable body 1 and the printed wiring board 22 is composed of a fixing metal plate 33, a film-like base material 31 and an adhesive 32. The fixing metal plate 33 is bonded to the base material 31 by the adhesive 32 provided on the base material 31, and the fixing member 30 is fixed to the surface of the covering member 3 on the lower side of the flat cable body 1 by the upper side adhesive 32.

The lower side of the fixing metal plate 33 (i.e., a side facing the printed wiring board 22) is exposed from the adhesive 32, as shown in FIG. 14. When the flat cable 9 is attached to the printed wiring board 22, the fixing metal plate 33 of the fixing member 30 is bonded and fixed to a corresponding surface electrode portion 34 formed on the surface of the printed wiring board 22 by a jointing material 35 such as solder material, as shown in FIG. 15. The conductor 2 of the flat cable body 1 is joined at the solder connection portion 6 to the corresponding electrode portion 23 formed on the printed wiring board 22, as shown in FIG. 15. The reinforcing member 10 is fixed to the printed wiring board 22 by inserting a non-illustrated insertion portion into the through-hole 26 formed on the printed wiring board 22 and then joining to the through-hole electrode portion 27 formed on the inner surface of the through-hole 26 by a joining material such as solder material.

The vibratile deformation of the conductor 2 of the flat cable body 1 in the vicinity of the solder connection portion 6 can be suppressed also in the modification of the present embodiment by using the reinforcing member 10 provided on the upper surface of the flat cable body 1 and fixed to the printed wiring board 22 and by using the fixing member 30 filling the gap between the lower surface of the flat cable body 1 and the printed wiring board 22 and respectively fixed thereto. Particularly, the lower surface of the fixing metal plate 33 constituting the fixing member 30 is exposed and is metallic bonded to the corresponding surface electrode portion 34 of the printed wiring board 22 using a solder material. Since a junction area between the fixing metal plate 33 and the surface electrode portion 34 is increased by providing the fixing member 30 so as to traverse across the conductors 2 arranged in parallel in a width direction thereof and strong metal joining is used, it is possible to realize firmer fixation. As a result, it is possible to further improve an effect of suppressing the vibratile deformation in the vicinity of the solder connection portion 6.

Although the embodiment of the invention has been described, the invention according to claims is not to be limited to the above-mentioned embodiment. Further, please note that not all combinations of the features described in the embodiment are not necessary to solve the problem of the invention.

What is claimed is:

1. A flat cable, comprising:

a plurality of conductors arranged in parallel and exposed at both end portions in a longitudinal direction thereof;

an insulation film covering the plurality of conductors except the exposed both end portions; and a reinforcing member that covers the plurality of conductors along a width direction of the plurality of conductors, is provided on a surface of the insulation film in a part of a region including an edge of the insulation film, and comprises a metal plate and an insulative covering layer for covering the metal plate.

2. The flat cable according to claim 1, wherein the plurality of conductors are arranged in parallel in the width direction to form a conductor group, the both end portions comprise externally exposed portions, the exposed portion comprises a conductor connecting portion provided in a region including a tip of the exposed portion so as to be connectable to an external conductor, and the reinforcing member partially covers the conductor group along a width direction to traverse thereacross and is provided so that a center of the reinforcing member is located a predetermined distance away from the edge of the insulation film.

3. The flat cable according to claim 2, wherein the reinforcing member is adapted to be fixed to an external printed wiring board.

4. The flat cable according to claim 3, wherein a portion of the metal plate of the reinforcing member comprises an exposed metal plate portion that is exposed from the insulative covering layer, and the exposed metal plate portion is adapted to be fixed to the external printed wiring board.

5. The flat cable according to claim 4, wherein the exposed metal plate portion is adapted to be inserted into and fixed to a through-hole in the external printed wiring board.

6. The flat cable according to claim 5, wherein the reinforcing member is provided on a surface of the insulation film that is not facing a surface of the external printed wiring board, and the flat cable further comprises an intervening portion provided on a surface of the insulation film facing a surface of the external printed wiring board at substantially the same position as the region provided with the reinforcing member so as to be positioned between the surface of the external printed wiring board and the insulation film.

7. The flat cable according to claim 6, wherein the intervening portion comprises a base material and an adhesive formed on both surfaces of the base material such that the adhesive allows the intervening portion to be bonded to the surface of the external printed wiring board and the insulation film.

8. A connection structure between a flat cable and a printed wiring board, comprising:

a printed wiring board; and a flat cable, wherein the flat cable comprises:

a plurality of conductors arranged in parallel and exposed at both end portions in a longitudinal direction thereof;

an insulation film covering the plurality of conductors except the exposed both end portions; and a reinforcing member that covers the plurality of conductors along a width direction of the plurality of conductors, is provided on a surface of the insulation film in a part of a region including an edge of the insulation film, and comprises a metal plate and an insulative covering layer for covering the metal plate, and wherein a portion of the reinforcing member is fixed to the printed wiring board.

9. The connection structure according to claim 8, wherein the plurality of conductors are arranged in parallel in the width direction to form a conductor group, the both end portions are externally exposed portions, the exposed portion comprises a conductor connecting portion provided in a region including a tip of the exposed portion so as to be connectable to an external conductor, the reinforcing member partially covers the conductor group along a width direction to traverse thereacross and is provided so that a center of the reinforcing member is located a predetermined distance away from the edge of the insulation film, and fixed to the printed wiring board, and the printed wiring board further comprises a plurality of electrode portions respectively connected to a plurality of the conductor connecting portions so as to respectively correspond to the plurality of conductors.

10. The connection structure according to claim 9, wherein a portion of the metal plate of the reinforcing member comprises an exposed metal plate portion that is exposed from the insulative covering layer, and the exposed metal plate portion is fixed to the printed wiring board.

11. The connection structure according to claim 10, wherein the exposed metal plate portion is inserted into and fixed to a through-hole of the printed wiring board.

12. The connection structure according to claim 10, wherein the reinforcing member is provided on a surface of the insulation film that is not facing a surface of the printed wiring board, and further comprised is an intervening portion provided on a surface of the insulation film facing a surface of the printed wiring board at substantially the same position as the region provided with the reinforcing member so as to be positioned between the surface of the printed wiring board and the insulation film.

13. The connection structure according to claim 12, wherein the intervening portion comprises a base material and an adhesive formed on both surfaces of the base material such that the adhesive allows the intervening portion to be bonded to the surface of the external printed wiring board and the insulation film.

* * * * *